US010465310B2

(12) United States Patent
Stone et al.

(10) Patent No.: US 10,465,310 B2
(45) Date of Patent: Nov. 5, 2019

(54) METHOD AND APPARATUS FOR ELECTROCHEMICAL ETCHING

(71) Applicant: THE UNIVERSITY OF DURHAM, Durham (GB)

(72) Inventors: Richard Stone, Durham (GB); Dagou Zeze, Durham (GB)

(73) Assignee: THE UNIVERSITY OF DURHAM, Durham (GB)

( * ) Notice: Subject to any disclaimer, the term of this patent is extended or adjusted under 35 U.S.C. 154(b) by 182 days.

(21) Appl. No.: 15/309,022

(22) PCT Filed: Apr. 28, 2015

(86) PCT No.: PCT/GB2015/051230
§ 371 (c)(1),
(2) Date: Nov. 4, 2016

(87) PCT Pub. No.: WO2015/173541
PCT Pub. Date: Nov. 19, 2015

(65) Prior Publication Data

US 2017/0088972 A1 Mar. 30, 2017

(30) Foreign Application Priority Data

May 15, 2014 (GB) ..... 1408655.7

(51) Int. Cl.

| | |
|---|---|
| ***C25F 3/02*** | (2006.01) |
| ***C25F 7/00*** | (2006.01) |
| ***C25F 3/00*** | (2006.01) |
| ***C25D 5/00*** | (2006.01) |

(52) U.S. Cl.
CPC ..... *C25F 3/02* (2013.01); *C25D 5/006* (2013.01); *C25F 3/00* (2013.01); *C25F 7/00* (2013.01)

(58) Field of Classification Search
CPC ..... C25F 3/02–14; B23H 9/08; B23H 7/38
USPC ..... 205/671, 664
See application file for complete search history.

(56) References Cited

U.S. PATENT DOCUMENTS

| | | | | |
|---|---|---|---|---|
| 2,803,595 | A | 8/1957 | Anzaldi | |
| 2006/0124472 | A1* | 6/2006 | Rokicki | C25F 3/16 205/640 |
| 2010/0243430 | A1 | 9/2010 | Yan et al. | |

FOREIGN PATENT DOCUMENTS

| | | |
|---|---|---|
| CN | 102554376 | 7/2012 |
| GB | 2220602 | 1/1990 |

OTHER PUBLICATIONS

"International Search Report and Written Opinion", International Application No. PCT/GB2015/051230, dated Jul. 24, 2015, 11 pages.

(Continued)

*Primary Examiner* — Brian W Cohen
(74) *Attorney, Agent, or Firm* — Billion & Armitage; Benjamin C. Armitage

(57) ABSTRACT

A method and apparatus for electrochemical etching are disclosed. The method comprises immersing parts of objects (2) to be etched in an electrolyte (4), applying a voltage between the objects (2) and at least one electrode (6) to cause an electrochemical reaction between the objects (2) and the electrolyte (4), and positioning the objects (2) and electrodes (6) relative to each other such that a reaction product accumulates on the objects (2) during the reaction to reduce the rate of the reaction.

20 Claims, 5 Drawing Sheets

(56) References Cited

OTHER PUBLICATIONS

Stone, "Tungstate sharpening: A versatile method for extending the profile of ultra sharp tungsten probes", Review of Scientific Instruments, AIP, Melville, NY, US, vol. 84, No. 3, Mar. 1, 2013, pp. 35107-1-35107-5.

* cited by examiner

METHOD AND APPARATUS FOR ELECTROCHEMICAL ETCHING

CROSS REFERENCE TO RELATED APPLICATIONS

This application is a national stage entry of International Application No. PCT/GB2015/051230, filed Apr. 28, 2016, which claims priority to GB Application No. 1408655.7, filed on May 15, 2014, the disclosures of which are incorporated by reference in their entirety.

TECHNICAL FIELD

The present invention relates to a method and apparatus for electrochemical etching and relates particularly, but not exclusively, to a method and apparatus for electrochemical etching for the purpose of sharpening probes or blades.

BACKGROUND

Microscopy methods, such as scanning tunnelling microscopy, require the use of probes having extremely sharp tips with well-defined shapes in order to provide a desired level of resolution for high quality images. A sharper probe, that is a probe with a narrower tip, provides higher resolution information about a sample while a well-defined probe shape lowers noise levels on resulting images.

Probes with sharp tips are known to be made using a process known as the "drop-off method". In this process, an object to be etched, such as a piece of tungsten wire, has a lower portion immersed in an electrolyte such as sodium hydroxide or potassium hydroxide, while an upper portion of the piece of wire remains in air. The depth of immersion of the lower portion is chosen depending on a desired drop-off time, which governs the ultimate shape of the tips formed by the process. A ring-shaped electrode is placed around the immersed portion of the piece of wire and a voltage is applied between the piece of wire and the electrode.

An electrochemical reaction takes place between the piece of wire and hydroxide ions in the electrolyte, creating water molecules and molecules of, in the case of the object being made of tungsten, an oxidised compound of tungsten and oxygen called tungstate. As the portion of the tungsten piece surrounded by the electrode decomposes in this way, a neck of decreasing radius is formed. The rate of decomposition of this portion is inhomogeneous due to two effects: the formation of a meniscus of electrolyte around the piece at the surface of the electrolyte, and the accumulation of tungstate as it descends as a viscous flow near the immersed surface of the piece. The process culminates in the lower part of the piece falling away as the neck breaks, resulting in the formation of two sharp tips, the shapes of which are dependent on the rate of etching. A high rate of etching results in irregularly-shaped tips, and a low rate of etching results in very long and fragile tips. The applied voltage must be immediately terminated upon breakaway of the lower part to prevent further undesired etching taking place. Only one pair of tips can be made at a time in this manner, and in practice it is often the case that only one of the tips of the pair is usable.

The shape of the tips can be further affected by the behaviour of the meniscus. As the neck radius decreases and the surface area of the neck increases during the reaction, the meniscus position can change, which leads to the formation of a second neck. This causes undesired variations in the shapes of the final tips, rendering them unsuitable for use in very sensitive applications. Control of the apparatus is required to prevent this from happening.

Preferred embodiments of the present invention seek to overcome one or more of the above disadvantages associated with the prior art.

SUMMARY

According to a first aspect of the present invention, there is a provided an electrochemical etching method comprising: immersing at least part of one first part of at least one object to be etched and at least part of at least one electrode in an electrolyte; and applying a voltage between at least one said object and at least one said electrode to cause an electrochemical reaction between at least one said first part and said electrolyte to cause at least one reaction product; wherein at least one said first part and at least one said electrode are positioned relative to each other such that at least part of at least one said reaction product accumulates by means of gravity on at least one said first part to reduce a reaction rate of said electrochemical reaction.

By positioning at least one said first part and at least one said electrode relative to each other such that at least part of at least one said reaction product accumulates by means of gravity on at least one said first part to reduce a reaction rate of said electrochemical reaction, the rate of the electrochemical reaction at each point on the surface of said first part is made dependent on its orientation, providing a scalable etching procedure with a simpler apparatus.

The method may further comprise providing a magnetic field in the vicinity of at least one said first part to cause flow of said electrolyte to adjust said reaction rate.

This provides the advantage that the rate of electrochemical etching of the object can be adjusted by the magnetic field.

The magnetic field may be adjustable.

This provides the advantage of providing further control of the rate of electrochemical etching of the object.

The method may further comprise surrounding at least one second part of at least one said object by at least one electrically insulating material.

This provides the advantage of protecting the second part of the object from the etching process.

At least one said electrically insulating material may be immiscible with the electrolyte and more dense than the electrolyte.

At least one said electrically insulating material may comprise perfluorinated carbon fluid.

The method may further comprise controlling said voltage.

Said voltage may be controlled in dependence on an electrical current drawn by said electrochemical reaction.

This provides the advantage of allowing the etching process to be dynamic.

Said voltage may be controlled in dependence on a profile of at least part of at least one said first part.

This provides the advantage that the final lengths and sharpnesses of a plurality of objects being etched simultaneously can be made substantially equal.

At least one said first part may be elongate.

At least one said first part may be a sheet of material.

According to a second aspect of the present invention, there is provided an electrochemical etching apparatus comprising: at least one electrode; container means for accommodating at least one first part of at least one object to be etched such that at least one said first part and at least part of at least one said electrode are immersed in an electrolyte; and voltage application means for applying a voltage between at least one said object and at least one said electrode to cause an electrochemical reaction between at least one said first part and said electrolyte to cause at least one reaction product; wherein at least one said first part and at least one said electrode are positioned relative to each other such that at least part of at least one said reaction product accumulates by means of gravity on at least one said first part to reduce a reaction rate of said electrochemical reaction.

The apparatus may further comprise magnetic field generating means for providing a magnetic field in the vicinity of at least one said first part to cause flow of said electrolyte to adjust said reaction rate.

The magnetic field generating means may be adapted to provide an adjustable magnetic field.

This provides the advantage of controlling the flow of the electrolyte, and therefore the rate of the electrochemical reaction.

The container means may be adapted to accommodate at least one second part of at least one said object such that at least one said second part is surrounded by at least one electrically insulating material.

The apparatus may further comprise voltage control means for controlling said voltage.

The voltage control means may be adapted to control said voltage in dependence on an electrical current drawn by at least part of said apparatus.

The voltage control means may be adapted to control said voltage in dependence on a profile of at least part of at least one said first part.

BRIEF DESCRIPTION OF DRAWINGS

A preferred embodiment of the present invention will now be described, by way of example only and not in any limitative sense, with reference to the accompanying drawings, in which.

DETAILED DESCRIPTION

Figure 1:
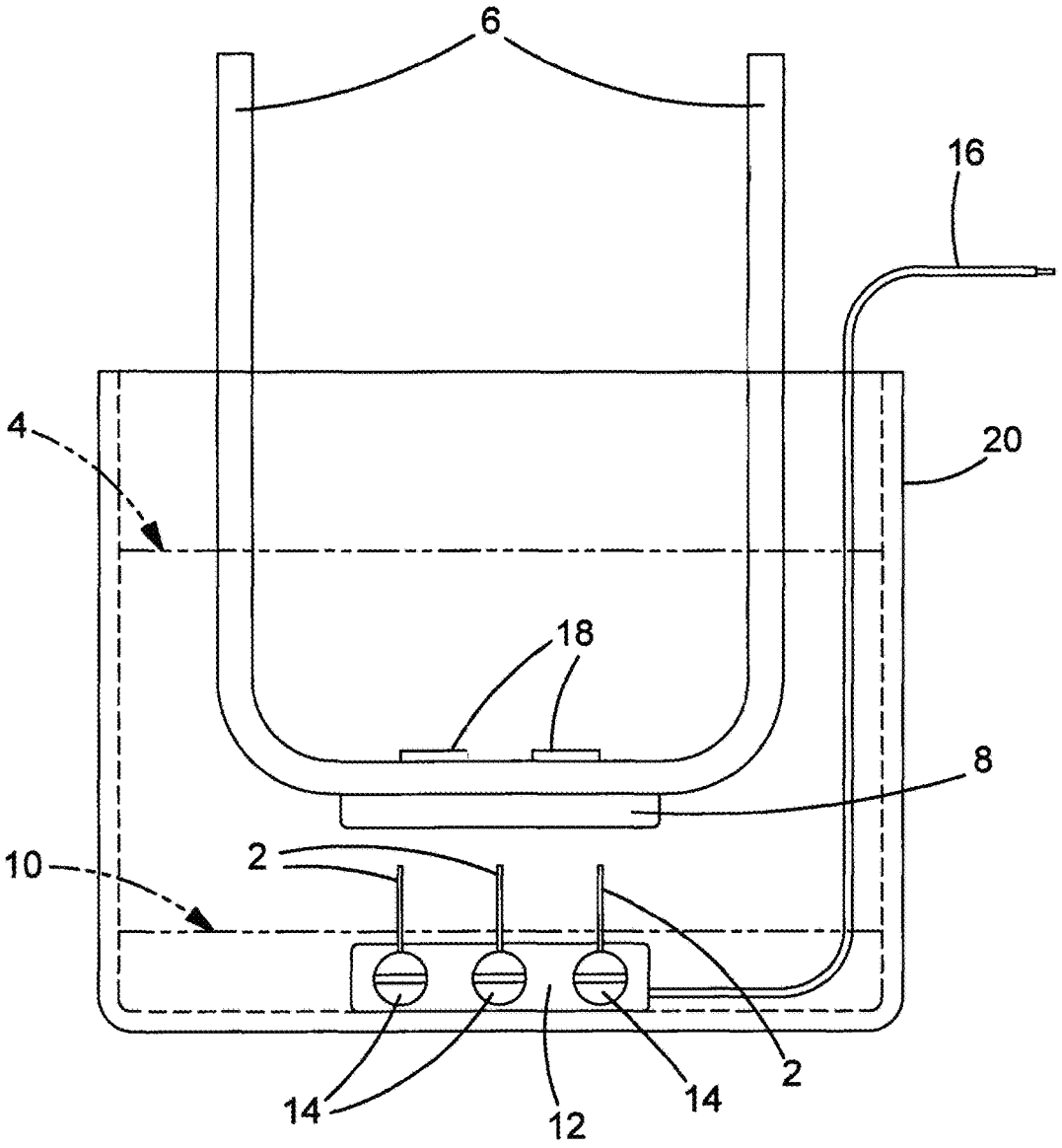
FIG. 1 is a front view of an electrochemical etching apparatus embodying the present invention.
Figure 2:
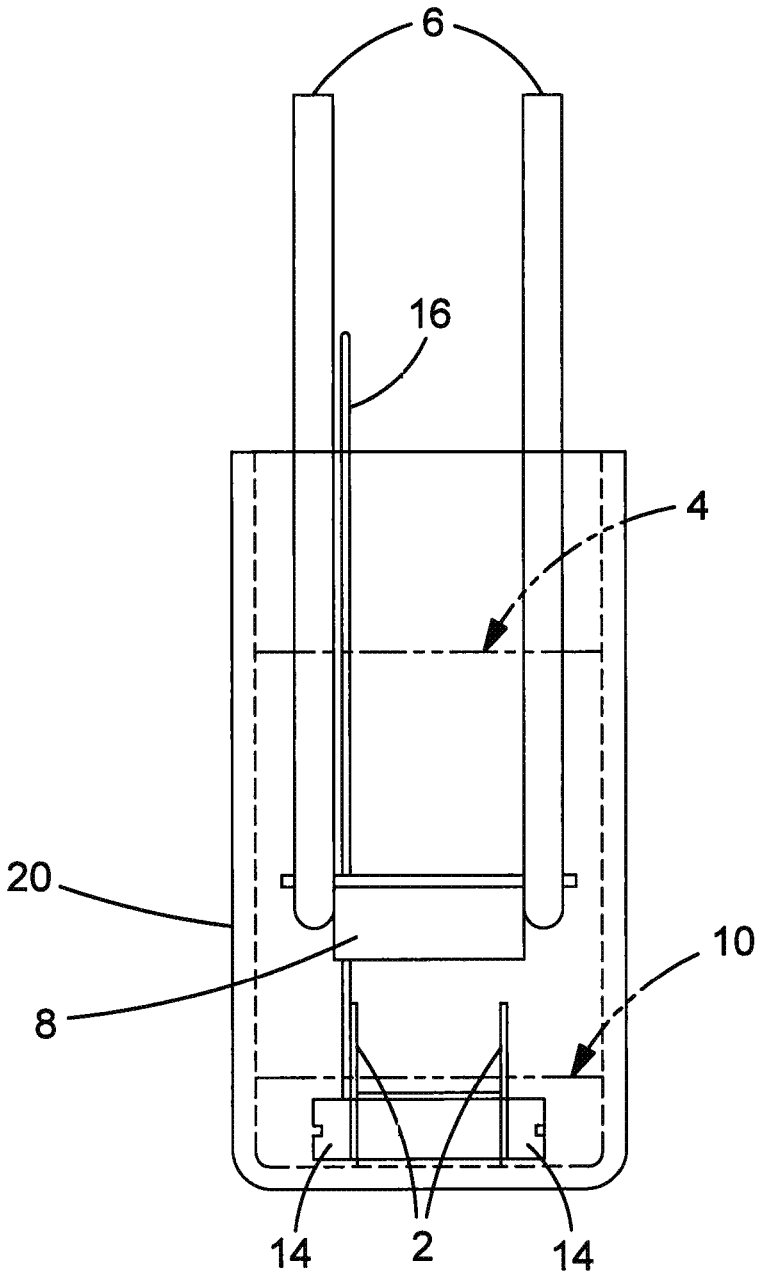
FIG. 2 is a side view of the apparatus of FIG. 1.
Figure 3:
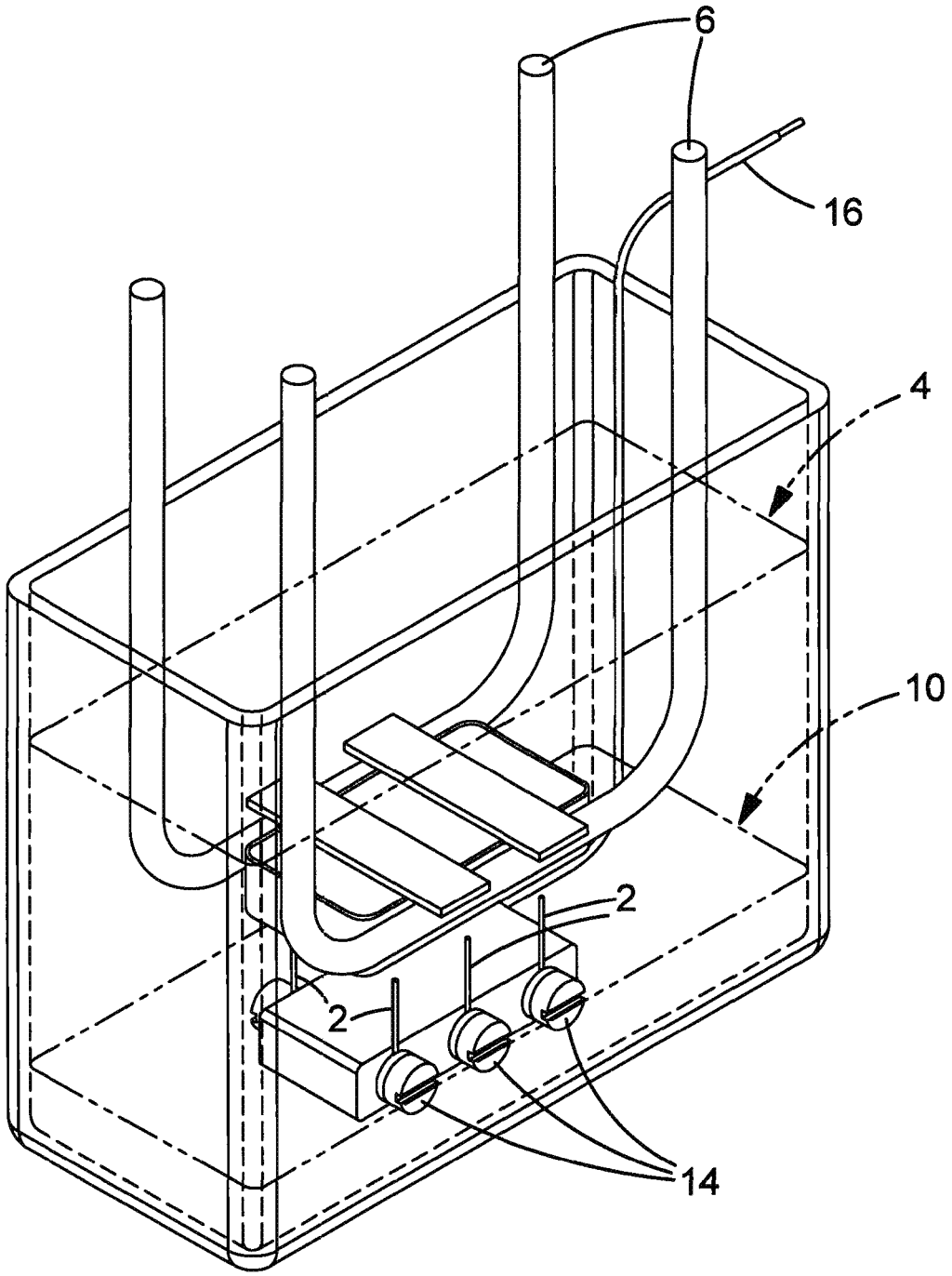
FIG. 3 is a perspective view of the apparatus of FIG. 1.

Referring to FIGS. 1 to 3, five cylindrically-shaped pieces of tungsten wire (2) of diameter 10 mm are secured to a stainless steel block (12) using stainless steel screws (14). One end of an insulated wire (16) is also secured to the block (12) by means of a screw (14), while another end of the wire (16) is connected to a power supply (not shown). The block (12), screws (14) and lower parts of each of the pieces of tungsten wire (2) are immersed in an electrically insulating layer of C-15 perfluorinated carbon fluid (10), while the upper parts of the pieces of tungsten wire (2) protrude upwards from the fluid (10) into a layer of potassium hydroxide electrolyte (4) above. Positioned above the pieces of tungsten wire (2) are two U-shaped stainless steel electrodes (6) connected to the power supply and a substantially rectangular permanent magnet (8), the magnet (8) secured between the electrodes (6) by means of two plastic struts (18) adhered to both the magnet (8) and each electrode (6). The magnet (8) is oriented such that one of its poles points towards the pieces (2). In FIGS. 1-3, the face of the magnet (8) nearest the pieces (2) is a pole of the magnet. The magnet (8), struts (18) and a part of each electrode (6) are immersed in the electrolyte (4). The electrodes (8) are placed at a distance of 20 mm above the ends of the pieces of tungsten wire (2). The fluid (10) and electrolyte (4) are contained within a glass container (20).

Figure 4:
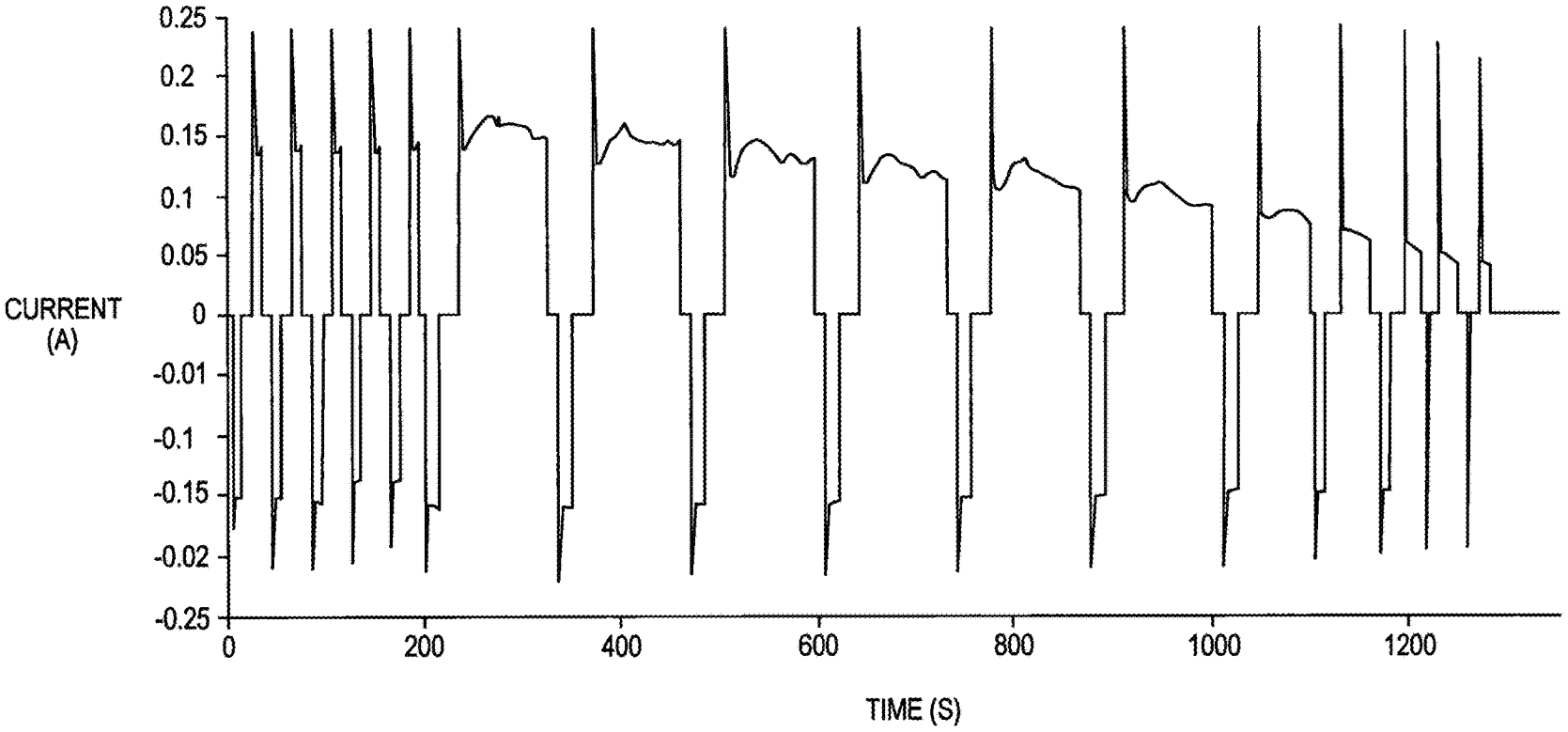
FIG. 4 is a graph showing a profile of a current drawn from the power supplying means during a process embodying the present invention.
Figure 5:
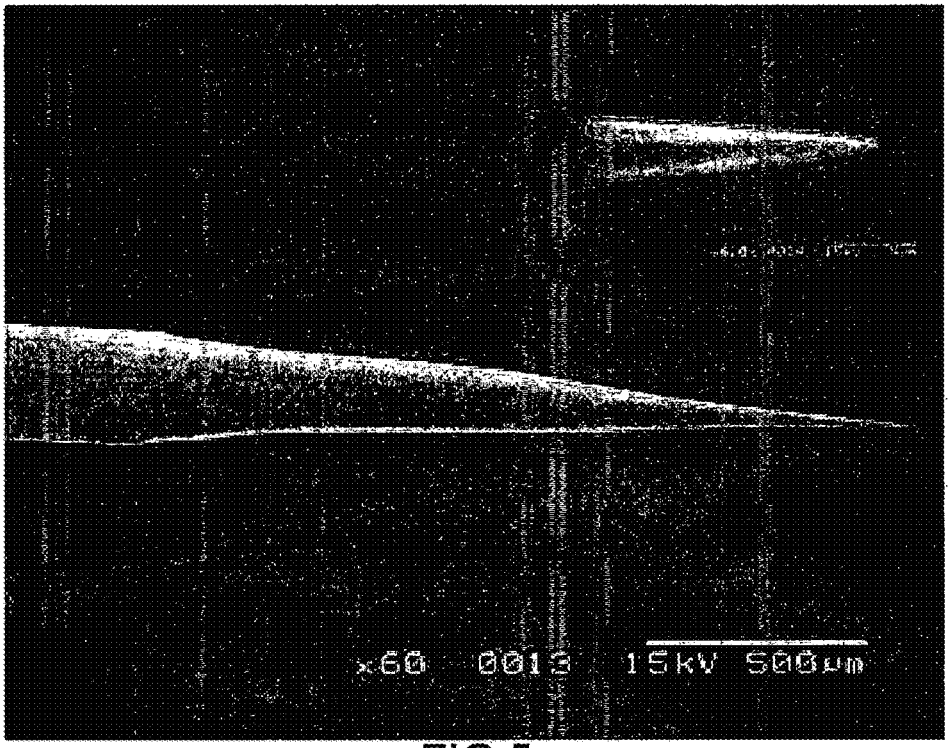
FIG. 5 is an image, generated by a scanning electron microscope, of a probe etched according to an embodiment of the present invention.
Figure 6:
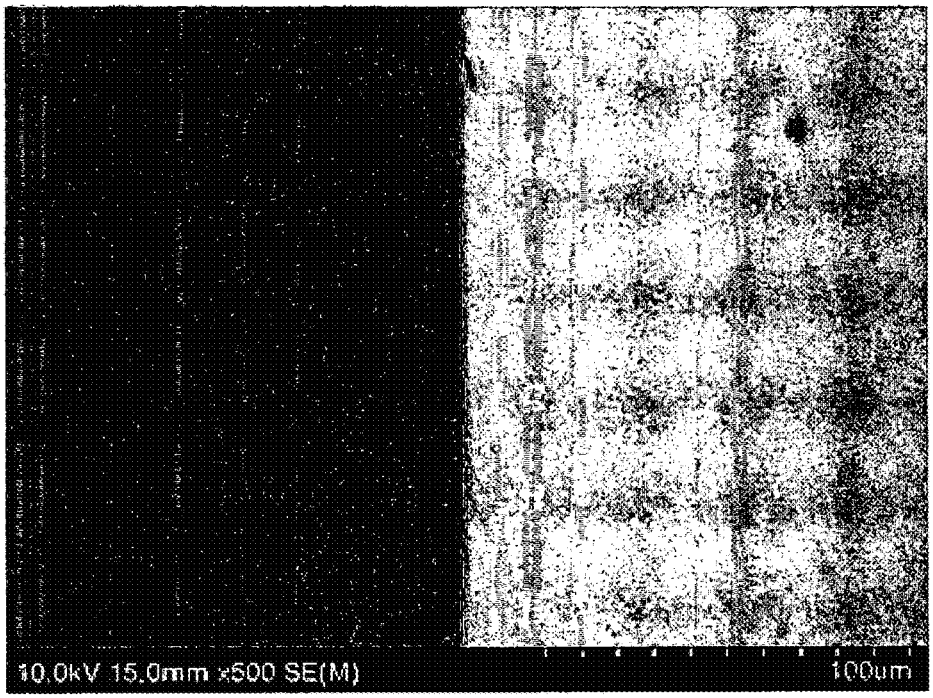
FIG. 6 is an image, generated by a scanning electron microscope, of an edge of a razor blade etched according to an embodiment of the present invention.

The pieces of tungsten wire (2) and electrodes (4) are energised by a voltage supplied by the power supply. The voltage supplied by the power supply to the pieces of tungsten wire (2) and the electrodes (4) is controlled by a microcontroller and a computer program. The microcontroller measures a current drawn from the power supply during the etching process and the computer program adjusts a duty cycle and polarity of the voltage supplied depending on the current drawn. An example of a profile of the current drawn from the power supply during an etching process embodying the present invention is shown in FIG. 4.

While the pieces of tungsten wire (2) and the electrodes (4) are energised, a voltage is applied between the pieces (2) and the electrodes (4) causing an electrochemical reaction to take place at the interface between the surface of each piece of tungsten wire (2) that is exposed to the electrolyte (4) and the electrolyte. The product of the reaction is denser than the electrolyte. The product forms a layer around each piece of tungsten wire (2) from which it originated and flows downwards, in a viscous manner, due to the force of gravity. Each layer of the product surrounding each piece of tungsten wire (2) partially insulates the surface of the respective piece of tungsten wire (2) from the electrolyte (4), consequently reducing a rate at which the surface of that piece of tungsten wire (2) decomposes. As the reaction continues, the product near to each piece of tungsten wire (2) accumulates, creating a layer of product near to each piece of tungsten wire (2) which is thinner at the ends of the pieces of tungsten wire (2) closest to the electrodes (6) than at the opposite ends of the pieces of tungsten wire (2), consequently causing the rate at which each point on the surface of each piece of tungsten wire (2) decomposes to be dependent on a distance of those points from the electrodes (6). As a result, each piece (2) decomposes into a substantially conically-shaped piece of tungsten with a sharp point at the end of each piece of tungsten nearest the electrodes (6).

During the electrochemical reaction, the magnet (8) radiates a magnetic field (not shown) which interacts with ions in the electrolyte. Given the position and orientation of the magnet (8) as shown in FIGS. 1-3 and described above, the magnetic field accelerates the ions moving toward each piece of tungsten wire (2), by means of a Lorentz force, along a substantially circular path around each piece (2), creating a flow. Since the magnetic field strength decreases with distance from the magnet (8), a rate of the flow around each piece of tungsten wire (2) also decreases with that distance, the flow rate being proportional to the Lorentz force and therefore to the magnetic field strength. As a result, the greater flow rate at the ends of each piece of tungsten wire (2) nearest the magnet (8) causes faster circulation of the electrolyte around each piece of tungsten wire (2). The rate of decomposition of the surface of each piece of tungsten wire (2) is proportional to a rate of this circulation, therefore the generation of a circulation profile around each piece (2), via the presence of the magnetic field in the electrolyte, causes the decomposition of the surface of each piece of tungsten wire (2) to be well-defined and controllable in terms of the magnetic field.

If two or more pieces of tungsten wire (2) are to be etched simultaneously, the etching process may be allowed to continue for a period of time after one or more sharp points have been formed, for the purpose of equalising the lengths and sharpnesses of the pieces of tungsten wire (2). The combination of the divergent magnetic field and the accumulation of the product during the reaction ensures that each piece of tungsten wire (2) experiences a rate of etching dependent on its proximity to the magnet (8), and therefore that a piece of tungsten wire (2) to be etched that is longer than another when the reaction begins, and therefore is closer to the magnet (8), is etched at a greater rate than a shorter piece of tungsten wire (2).

The embodiment described above may be adapted for the etching of conductive sheets such as stainless steel razor blades rather than the aforementioned pieces of tungsten wire (2) by replacing the piece or pieces of tungsten wire (2) with the sheet or sheets, substituting the potassium hydroxide for 2M hydrochloric acid as the electrolyte (4) and appropriately adjusting the computer program.

The object or objects to be etched may be made from a material other than tungsten or stainless steel. Any conductive material that can be electrochemically etched and that has a chemical by-product that flows downwards and partially insulates the object from further etching in the manner described above is suitable. Examples of such materials are nickel, copper, and silicon.

It will be appreciated by persons skilled in the art that the above embodiment has been described by way of example only and not in any limitative sense, and that various alterations and modifications are possible without departure from the scope of the invention as defined by the appended claims.

What is claimed is:

1. An electrochemical etching method comprising:

immersing at least one first part of at least one object to be etched and at least part of at least one electrode in an electrolyte; and applying a voltage between said at least one object and said at least one electrode to cause an electrochemical reaction between said at least one first part and said electrolyte to cause at least one reaction product;

wherein said at least one first part and said at least one electrode are positioned relative to each other such that at least part of said at least one reaction product flows downwards by means of gravity and accumulates on said at least one first part to reduce a reaction rate of said electrochemical reaction;

further comprising providing a magnetic field in the vicinity of said at least one first part to cause flow of said electrolyte to adjust said reaction rate, wherein a strength of said magnetic field decreases in a downward direction.

2. A method according to claim 1, further comprising adjusting said magnetic field to control a rate of electrochemical etching of said at least one first part.

3. A method according to claim 1, further comprising surrounding at least one second part of said at least one object by at least one electrically insulating material.

4. A method according to claim 3, wherein said at least one electrically insulating material is a fluid immiscible with the electrolyte and is more dense than the electrolyte.

5. A method according to claim 4, wherein said at least one electrically insulating material comprises perfluorinated carbon fluid.

6. A method according to claim 1, further comprising controlling said voltage.

7. A method according to claim 5, wherein said voltage is controlled in dependence on an electrical current drawn by said electrochemical reaction.

8. A method according to claim 5, wherein said voltage is controlled in dependence on a profile of at least part of said at least one first part.

9. A method according to claim 1, wherein said at least one first part is elongate.

10. A method according to claim 1, wherein said at least one first part is a sheet of material.

11. An electrochemical etching apparatus comprising:

at least one electrode;

at least one container for accommodating at least one first part of at least one object to be etched such that said at least one first part and at least part of said at least one electrode are immersed in an electrolyte; and at least one voltage application device for applying a voltage between said at least one object and said at least one electrode to cause an electrochemical reaction between said at least one first part and said electrolyte to cause at least one reaction product;

wherein said at least one first part and said at least one electrode are positioned relative to each other such that at least part of said at least one reaction product flows downward by means of gravity and accumulates on said at least one first part to reduce a reaction rate of said electrochemical reaction;

further comprising at least one magnetic field generating device for providing a magnetic field in the vicinity of said at least one first part to cause flow of said electrolyte to adjust said reaction rate, wherein a strength of said magnetic field decreases in a downward direction.

12. An apparatus according to claim 11, wherein said at least one magnetic field generating device is adapted to provide an adjustable magnetic field.

13. An apparatus according to claim 11, wherein said at least one container is adapted to accommodate at least one second part of said at least one object such that said at least one second part is surrounded by at least one electrically insulating material.

14. An apparatus according to claim 11, further comprising at least one voltage control device for controlling said voltage.

15. An apparatus according to claim 14, wherein said at least one voltage control device is adapted to control said voltage in dependence on an electrical current drawn by at least part of said apparatus.

16. An apparatus according to claim 14, wherein said at least one voltage control device is adapted to control said voltage in dependence on a profile of at least part of said at least one first part.

17. An apparatus according to claim 13, wherein said at least one electrically insulating material is a fluid immiscible with the electrolyte and is more dense than the electrolyte.

18. An apparatus according to claim 13, wherein said at least one electrically insulating material comprises perfluorinated carbon fluid.

19. A method according to claim 3, wherein said at least one object is arranged such that said at least one second part is lower than said at least one first part.

20. An apparatus according to claim 13, wherein said container is adapted to accommodate said at least one first part and said at least one second part of said object such that said at least one second part is lower than said at least one first part.

* * * * *